US005598132A

United States Patent [19]

Stabile

[11] Patent Number: 5,598,132

[45] Date of Patent: Jan. 28, 1997

[54] SELF-TERMINATING COAXIAL CONNECTOR

[75] Inventor: David J. Stabile, Horseheads, N.Y.

[73] Assignee: LRC Electronics, Inc., Horseheads, N.Y.

[21] Appl. No.: 591,385

[22] Filed: Jan. 25, 1996

[51] Int. Cl.[6] ..... H01P 1/10; H01P 1/26; H01R 17/12; H01R 33/96

[52] U.S. Cl. ..... 333/22 R; 333/260; 439/188

[58] Field of Search ..... 333/22 R, 260; 439/188, 578

[56] References Cited

U.S. PATENT DOCUMENTS

| | | | |
|---|---|---|---|
| 3,873,785 | 3/1975 | Lieberman | 333/260 |
| 4,575,694 | 3/1986 | Lapke et al. | 333/22 R |
| 4,660,921 | 4/1987 | Hauver | 439/578 |
| 4,971,569 | 11/1990 | Gooch et al. | 333/22 R X |
| 5,237,293 | 8/1993 | Kan et al. | 333/22 R |

*Primary Examiner*—Paul Gensler

*Attorney, Agent, or Firm*—Weingarten, Schurgin, Gagnebin & Hayes LLP

[57] ABSTRACT

A self-terminating coaxial connector provides for automatic termination of a coaxial cable. The connector includes an internal termination resistor which is only connected in series between the central conductor of a first cable and a grounded body of the connector when a second cable is not installed on the end of the connector. When a second cable is installed on the connector, the terminator resistor is disconnected from the grounded body, thereby removing the termination from the central conductor of the first cable.

9 Claims, 4 Drawing Sheets

SELF-TERMINATING COAXIAL CONNECTOR

FIELD OF THE INVENTION

The present invention relates to connectors, and more particularly to coaxial connectors.

BACKGROUND OF THE INVENTION

Coaxial cables are used in many applications, such as local area networks or cable television (CATV). In these types of applications, when a computer system is removed from the local area network or a television receiver is removed from the CATV cabling network, the cable should be terminated to avoid undue signal reflections or an impedance mismatch. Prior cabling systems have implemented an external terminator which needs to be installed on the end of the cable once the computer system or the television receiver is disconnected from the cabling system. External terminators can become lost or misplaced, and require manual installation or removal whenever a computer system or television receiver is connected to or disconnected from the cabling system.

A self-terminating coaxial connector is described in U.S. Pat. No. 4,660,921 to Hauver (the '921 patent), assigned to LRC Electronics, to whom the present application is also assigned. The connector of the '921patent has a resistor which is bonded into a cavity in the body of the connector. The connector of the '921patent also includes a flat conductive element that contacts another conductive element which selectively makes contact with the resistor.

SUMMARY OF THE INVENTION

The present invention is a self-terminating coaxial connector. The connector features an internal termination resistor which is selectively employed dependent upon the presence of a coaxial cable on a first end of the connector. The body of the connector is grounded via the connection of a distribution cable to a second end of the connector. The distribution cable is a coaxial cable.

The termination resistor has a first lead electrically connected to a central assembly which is moveable to one of two positions within the connector. The central assembly comprises a first insulator supporting the termination resistor, a terminal assembly and a second insulator. The terminal assembly is in electrical communication with the first lead of the termination resistor. A first end of the terminal assembly is in electrical communication with a central conductor of the distribution cable. A second end of the terminal assembly connects to a central conductor of the coaxial cable when the coaxial cable is installed on the first end of the connector.

When the coaxial cable is not installed on the first end of the connector the central assembly is in a first position. A spring biases the central assembly such that the termination resistor is moved into a position whereby a second lead of the termination resistor is electrically connected to the grounded body of the connector. In this manner the central conductor of the distribution cable connected to the second end of the connector is terminated by the introduction of a series resistance between the center conductor and the grounded body.

When the coaxial cable is connected to the first end of the connector, the central assembly is moved into a second position in which the termination resistor is no longer in electrical contact with the body. In this position the connector is no longer providing termination to the central conductor of the distribution cable since the connection of the series resistance between the center conductor and ground has been broken. While in this second position the central conductor of the distribution cable attached to the second end of the connector is in electrical communication with a central conductor of the coaxial cable attached to the first end of the connector. The connector of the present invent provides self-termination with a minimum number of parts.

DESCRIPTION OF THE DRAWINGS

The invention will be more fully understood from the following detailed description taken in conjunction with the accompanying drawings in which.

DETAILED DESCRIPTION OF THE INVENTION

Figure 1:
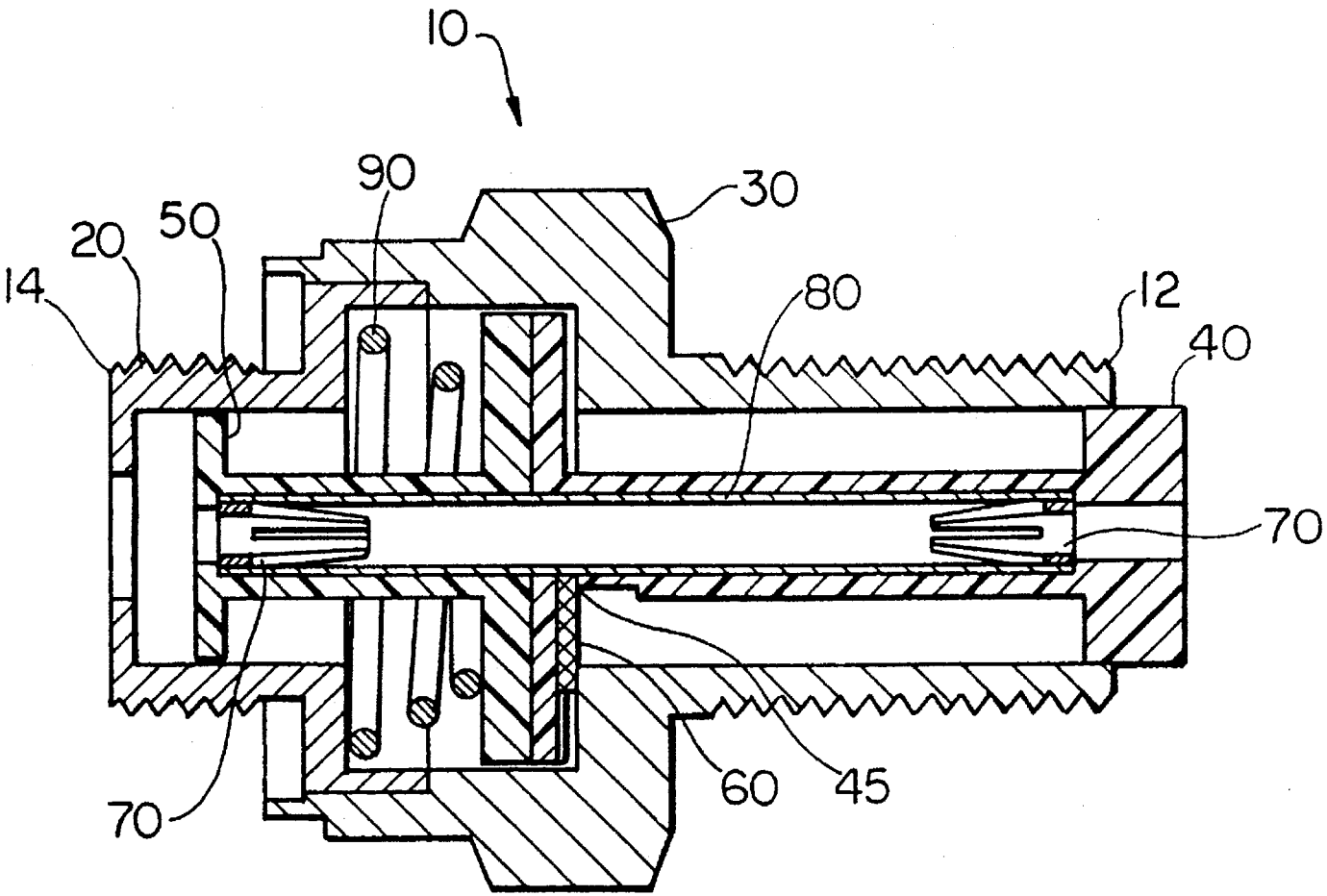
FIG. 1 is a cross-section view of the self-terminating connector.
Figure 2:
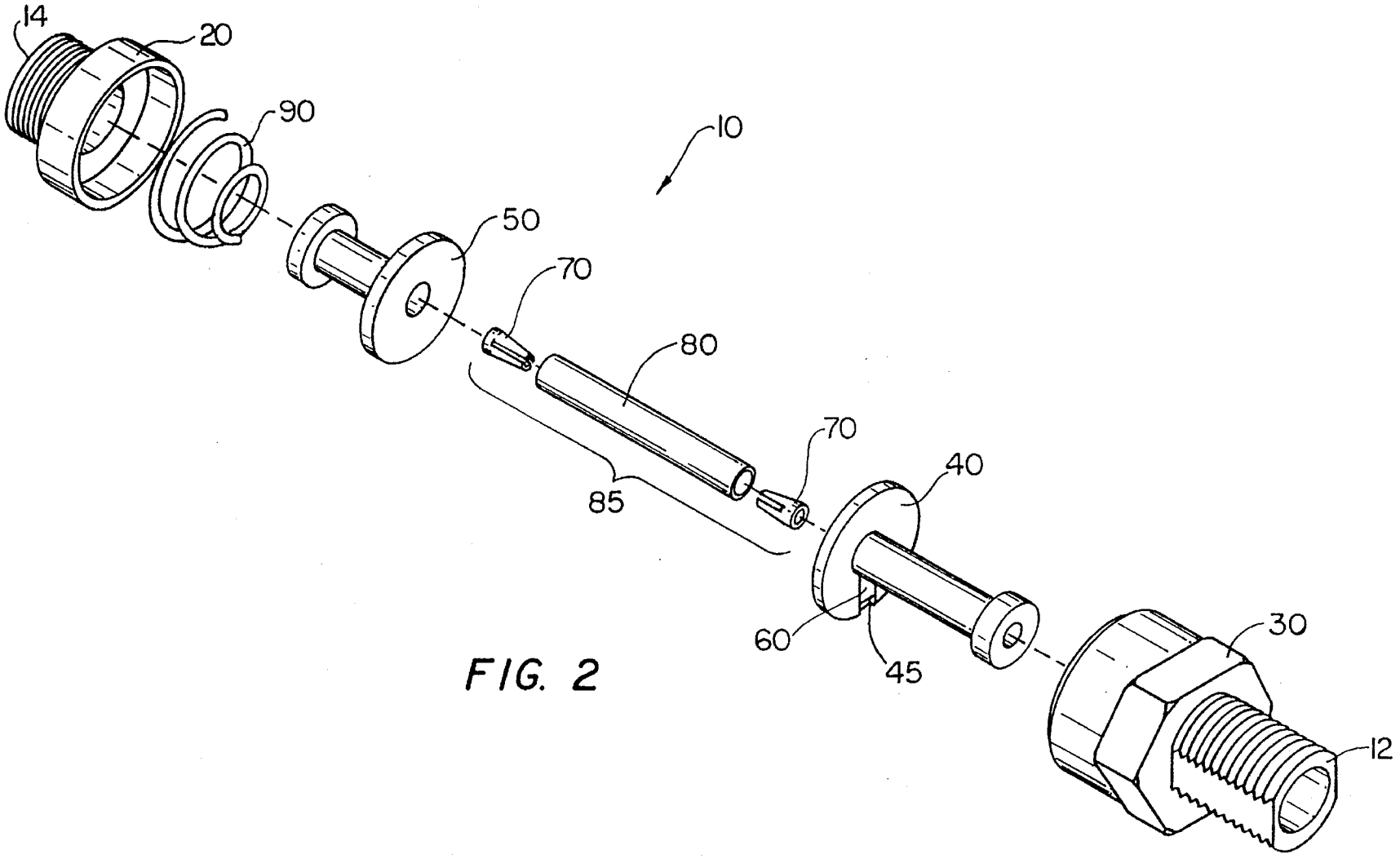
FIG. 2 is an exploded view of the self-terminating connector.

FIGS. 1 and 2 show the self-terminating connector 10 of the present invention. The connector 10 is comprised of an electrically conductive body 30, open at each of two ends, which has a central bore disposed therethrough. The first end of the body 30 has threads for receiving a coaxial cable or the like. A first insulator 40 fits into a second end of the body 30, and is moveable within the body 30 to one of two positions. The first insulator 40 includes a recess 45 for supporting a termination resistor 60. In a preferred embodiment the termination resistor 60 is a surface mount resistor and has a value of 75 ohms, though in alternate embodiments different form factors and resistance values could be used.

The first insulator 40 has a central bore disposed therethrough into which fits an electrically conductive terminal assembly 85. The terminal assembly 85 comprises a tubular terminal 80 having a contact 70 at each of two ends. The terminal assembly 85 is partially disposed within the bore of the first insulator 40. The recess 45 in the first insulator 40 allows for the first lead of the termination resistor 60 to be in constant electrical contact with the terminal 80. In the preferred embodiment the termination resistor 60 is bonded to terminal 80 with an electrically conductive epoxy.

Figure 3:
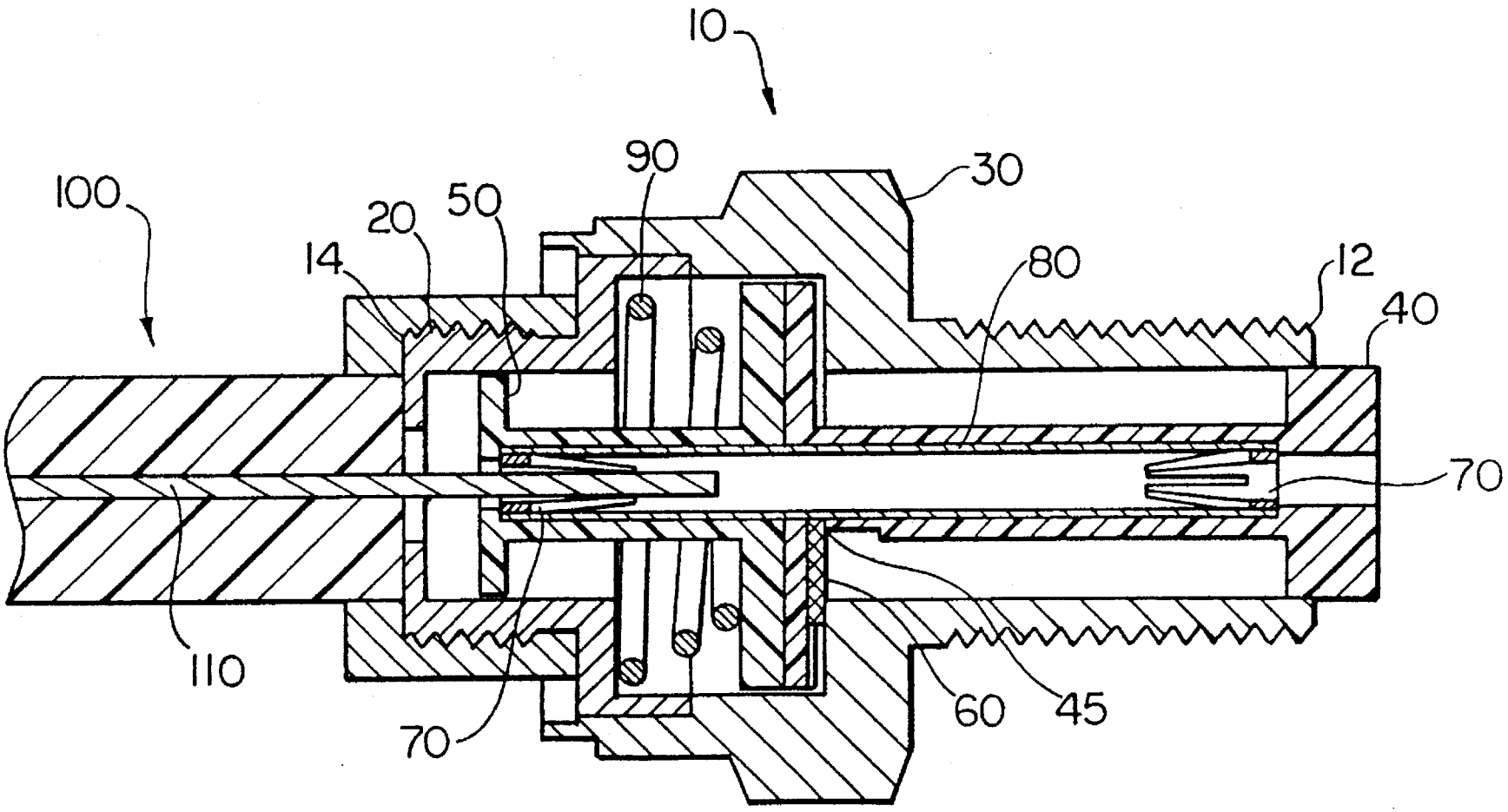
FIG. 3 is a cross-sectional view of the self-terminating connector in a first position resulting in termination of a cable.

A second insulator 50 has a central bore disposed therethrough and surrounds a portion of the terminal 80. A spring 90 is disposed about the outside surface of the second insulator 50. An end cap 20 has a central bore disposed therethrough and is open on each of two ends. A first end of the end cap 20 fits over the second insulator 50 and the spring 90, and is mated with the second end of body 30, the end cap and body thereby surrounding the first insulator 40, the second insulator 50, the terminal assembly 85 and the spring 90. A second end of the end cap 20 has threads for receiving a distribution cable or the like. When the distribution cable 100 (FIG. 3) is installed on a second end 14 of the connector 10 the body 30 and end cap 20 of the connector are grounded. In the preferred embodiment the body 30, end cap 20 and terminal assembly 85 are comprised of an electrically conductive material such as brass.

The first insulator 40, second insulator 50, terminal assembly 85, termination resistor 60 and spring 90 are movable to two positions. A first position, shown in FIG. 3, results in termination of the distribution cable 100. When a coaxial cable is not installed on the first end 12 of the connector 10 the spring 90 provides bias to place the first insulator 40, second insulator 50, terminal assembly 85 and termination resistor 60 into a position such that the termination resistor 60 has a second lead in electrical communication with the body 30, the body 30 being grounded. In such a position the termination resistor 60 is in series between the terminal 80 and the body 30. The connector. 10 is thus terminating the center conductor 110 of distribution cable 100 connected to the second end 14 of connector 10 by providing a series resistance between the center conductor 110 and the grounded body 30.

Figure 4:
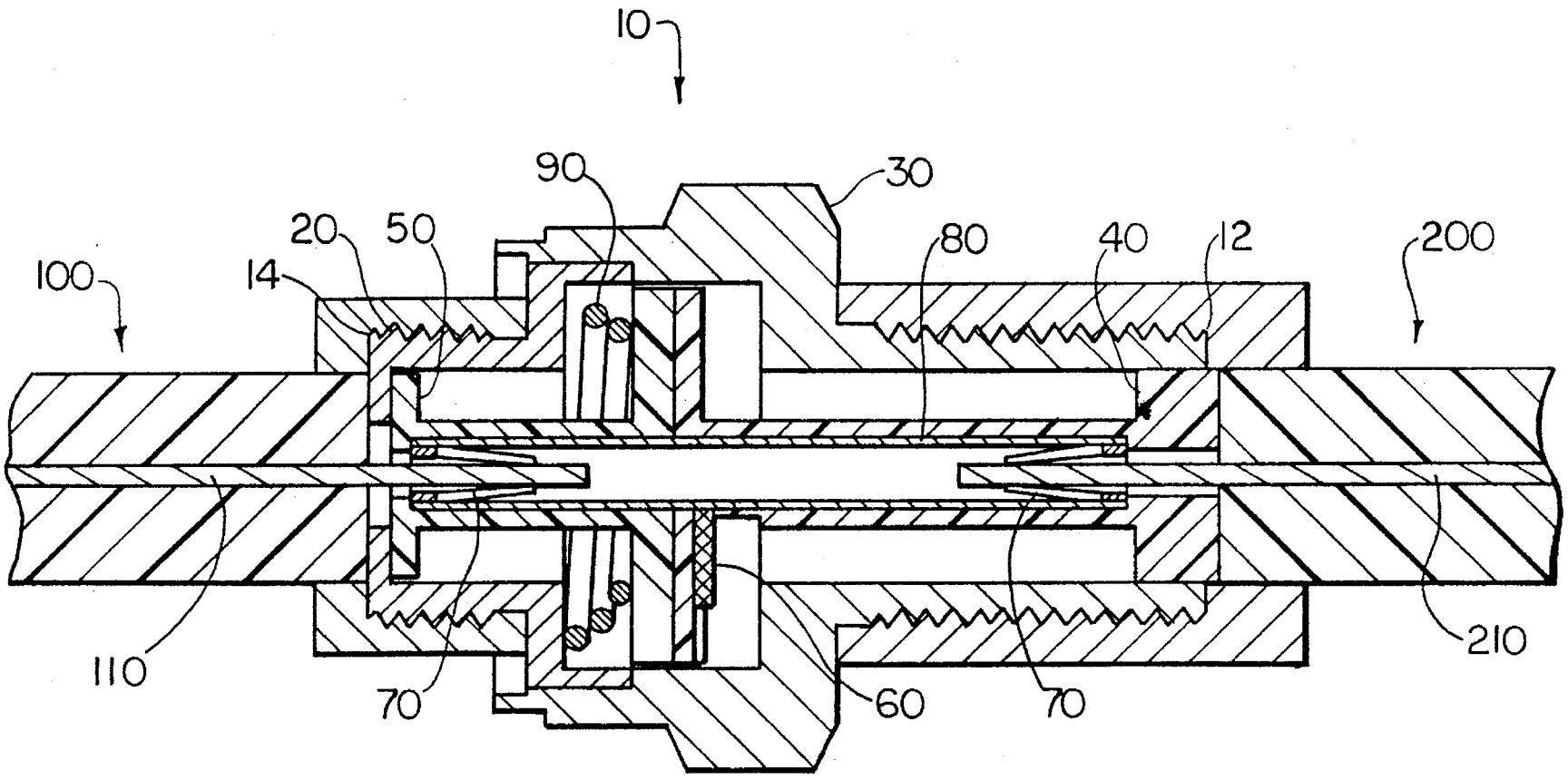
FIG. 4 is a cross-sectional view of the self-terminating connector in a second position in which no termination is provided.

A second position, shown in FIG. 4, results when a coaxial cable 200 is connected to the first end 12 of the connector 10. In this position the installation of a coaxial cable 200 onto the first end 12 of the connector 10 provides enough force to overcome the bias provided by spring 90. The first insulator 40, second insulator 50, terminal assembly 85 and spring 90 are moved to a position such that the termination resistor 60 is no longer in electrical communication with the body 30. As such, the center conductor 110 of distribution cable 100 is no longer terminated, since the connection between the termination resistor 60 and the grounded body 30 has been broken. However, the center conductor 110 of distribution cable 100 is now in electrical communication with the center conductor 210 of coaxial cable 200.

The connector of the present application provides for improved performance as compared to prior art connectors such as the connector recited by the '921 patent. With the connector of the present invention the return loss improves from approximately 31 dB to approximately −17 dB at −750 MHz. The use of a tubular terminal 80 and the orientation of having the termination resistor 60 conductively bonded directly to the terminal 80 provide for the improved performance of the present connector. Additionally the present connector requires less parts, is easier to assemble and is cheaper to manufacture and build.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

I claim:

1. A self-terminating coaxial connector comprising:

a body open on each of two ends, said body having a central bore disposed therethrough, a first end of said body for receiving a coaxial cable, a second end of said body having a mating area;

a first insulator having a central bore disposed therethrough, said first insulator movably disposed along a common longitudinal axis within said body, said first insulator having a recess from an outside surface thereof to said central bore of said first insulator;

a second insulator having a central bore disposed therethrough, said second insulator movably disposed along a common longitudinal axis within said body, a first end of said second insulator engaging a first end of said first insulator;

a spring, said spring disposed about said second insulator;

a terminal assembly, said terminal assembly comprising a tubular terminal disposed along a common longitudinal axis within said central bore of said first insulator and said central bore of said second insulator, said tubular terminal having a contact disposed at each end for receiving a center conductor of a cable;

a termination resistor disposed within said recess of said first insulator, said termination resistor having a first lead bonded to and electrically communicating with said tubular terminal;

an end cap open on each of two ends, said end cap having a central bore disposed therethrough, a first end of said end cap having a mating area cooperating with the mating area of said body, a second end of said end cap for receiving a distribution cable; and said first insulator, said second insulator, said terminal assembly and said termination resistor being movably disposed between a first position and a second position within said connector.

2. The self-terminating coaxial connector of claim 1 wherein said first position comprises said spring biasing said first insulator, said second insulator, said terminal assembly, and said termination resistor toward said first end of said body whereby a second lead of said termination resistor is in electrical contact with said body.

3. The self-terminating coaxial connector of claim 1 wherein said second position comprises said first insulator, said second insulator, said terminal assembly, and said termination resistor are displaced toward a second end of said end cap by the addition of a coaxial cable to said first end of said body whereby a second lead of said termination resistor is disconnected from said body and a center conductor of the distribution cable is in electrical communication with a center conductor of the coaxial cable.

4. The self-terminating coaxial connector of claim 1 wherein said termination resistor is attached to said terminal by conductive epoxy.

5. The self-terminating coaxial connector of claim 1 wherein said end cap, said body and said terminal assembly are comprised of electrically conductive material.

6. The self-terminating coaxial connector of claim 1 wherein said end cap, said body and said terminal assembly are comprised of brass.

7. The self-terminating coaxial connector of claim 1 wherein said first insulator and said second insulator are comprised of an insulating material.

8. The self-terminating coaxial connector of claim 1 wherein said terminating resistor is a surface mount resistor.

9. The self-terminating coaxial connector of claim 1 wherein said terminating resistor is a 75 ohm resistor.

* * * * *